US006991497B1

(12) United States Patent
Lin

(10) Patent No.: US 6,991,497 B1
(45) Date of Patent: Jan. 31, 2006

(54) EARPHONE JACK

(75) Inventor: Meng-Chin Lin, Taichung (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 10/933,311

(22) Filed: Sep. 3, 2004

(51) Int. Cl.
*H01R 24/04* (2006.01)

(52) U.S. Cl. ..... 439/668; 200/51.1

(58) Field of Classification Search ..... 439/668, 439/669; 200/51.1
See application file for complete search history.

(56) References Cited

U.S. PATENT DOCUMENTS 6,203,344 B1 * 3/2001 Ito ..... 439/218
6,220,899 B1 * 4/2001 Suzuki ..... 439/675
6,394,852 B1 * 5/2002 Huang ..... 439/669
6,461,198 B1 * 10/2002 Chao ..... 439/668
6,575,793 B1 * 6/2003 Li et al. ..... 439/668
6,592,408 B2 * 7/2003 Ma et al. ..... 439/669
6,595,804 B2 * 7/2003 Nagata ..... 439/668

* cited by examiner

*Primary Examiner*—Tho D. Ta
*Assistant Examiner*—Larisa Tsukerman
(74) *Attorney, Agent, or Firm*—Pillsbury Winthrop Shaw Pittman LLP

(57) ABSTRACT

An earphone jack includes a dielectric housing, a conductive first contact set, and a conductive second contact set. The housing has a first housing portion formed with a cylindrical first plug receiving hole, and a second housing portion connected to the first housing portion and formed with a rectangular second plug receiving hole. The first contact set includes first, second and third resilient contacts, each of which has a resilient plug contacting portion that extends into the first plug receiving hole. The second contact set includes a pair of first terminals and a pair of second terminals. The first terminals extend into the second plug receiving hole, and are disposed proximate to a lower side of the second housing portion. The second terminals extend into the second plug receiving hole, and are disposed proximate to an upper side of the second housing portion.

4 Claims, 8 Drawing Sheets

EARPHONE JACK

BACKGROUND OF THE INVENTION

1. Field of the Invention

The invention relates to an earphone jack, more particularly to an earphone jack that is capable of mating with two different types of plugs.

2. Description of the Related Art

Referring to FIG. 1, a conventional earphone jack 1 for use in an electrical device, such as a personal digital assistant (PDA), a mobile phone, etc., is shown to include an L-shaped dielectric housing 11, four first terminals 12, two second terminals 13, and a third terminal 14.

The dielectric housing 11 is formed with a cylindrical first plug receiving hole 111 that extends along a first hole axis (L11), and a rectangular second plug receiving hole 112 that extends along a second hole axis (L12) parallel to the first hole axis (L11) and that has a width along a third axis (d2) transverse to the second hole axis (L2).

Each of the first terminals 12 has a plug contacting portion (not shown) that extends into the second plug receiving hole 112, and an opposite tail portion 121 that is disposed outwardly of the second plug receiving hole 112. The first terminals 12 are arranged spacedly along the third axis (d2).

Each of the second terminals 13 has a plug contacting portion (not shown) that extends into the first plug receiving hole 111, and an opposite tail portion 131 that is disposed outwardly of the first plug receiving hole 111. The second terminals 13 are arranged spacedly along the first hole axis (L11).

The third terminal 14 is extended into a rear end of the first plug receiving hole 111, and has a tail portion 141 disposed outwardly of the first plug receiving hole 111.

In practice, the first, second and third terminals 12, 13, 14 can be connected to various electrical components, such as control circuits, state switching circuits, etc., via the tail portions 121, 131, 141 to provide a plurality of functions for the earphone jack 1.

In use, first and second plugs (not shown) are inserted into the first and second plug receiving holes 111, 112, and establish electrical connection with the plug contacting portions of the first, second and third terminals 12, 13, 14. As a result, electrical signals can be transmitted from the first and second plugs to the electrical components of an electrical device in a manner well known in the art via the terminals 12, 13, 14 of the earphone jack 1.

However, due to the arrangement of the first terminals 12, the third axis (d2) of the second plug receiving hole 112 of the dielectric housing 11 is relatively long. As a result, the dimensions of a housing part 110 of the dielectric housing 11 are too large to meet current trends toward component miniaturization.

SUMMARY OF THE INVENTION

Therefore, the object of the present invention is to provide an earphone jack that has a compact configuration so as to overcome the aforesaid drawback of the prior art.

Accordingly, an earphone jack of this invention comprises a dielectric housing, a conductive first contact set, and a conductive second contact set.

The dielectric housing has a first housing portion formed with a cylindrical first plug receiving hole that extends along a first axis, and a second housing portion connected to the first housing portion and formed with a rectangular second plug receiving hole that extends along a second hole axis parallel to the first hole axis and that has a width along a third axis transverse to the second hole axis. The second housing portion includes upper and lower wall parts at upper and lower sides of the second plug receiving hole.

The conductive first contact set is mounted to the first housing portion, and includes first, second and third resilient contacts, each of which has a resilient plug contacting portion that extends into the first plug receiving hole. The plug contacting portions of any pair of the first, second and third resilient contacts form at least one of an angular distance and an axial distance therebetween with respect to the first hole axis.

The conductive second contact set is mounted to the second housing portion, and includes a pair of first terminals and a pair of second terminals. The first terminals extend into the second plug receiving hole parallel to the second hole axis, are spaced apart from each other along the third axis, and are disposed proximate to the lower wall part of the second housing portion. The second terminals extend into the second plug receiving hole parallel to the second hole axis, are spaced apart from each other along the third axis, and are disposed proximate to the upper wall part of the second housing portion.

BRIEF DESCRIPTION OF THE DRAWINGS

Other features and advantages of the present invention will be come apparent in the following detailed description of the preferred embodiment with reference to the accompanying drawings, of which.

DETAILED DESCRIPTION OF THE PREFERRED EMBODIMENT

Figure 1:
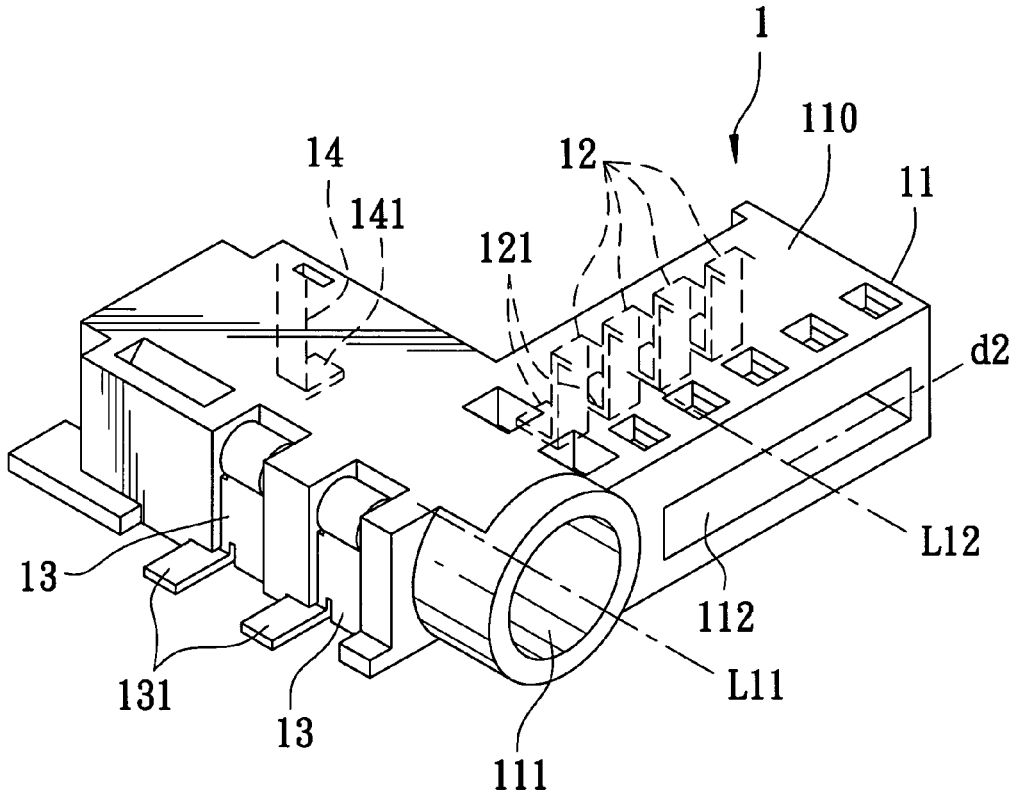
FIG. 1 PRIOR ART
FIG. 1 is an assembled perspective view of a conventional earphone jack.

Referring to FIGS. 2 to 5, the preferred embodiment of an earphone jack 3 according to the present invention is shown to be adapted for use with a complementary plug assembly 2 that includes a cylindrical first plug 21 and a rectangular second plug 22 disposed parallel to and spaced apart from the first plug 21. The first plug 21 includes a peripheral contacting surface 211. The second plug 22 includes a plug body 221 and two pairs of parallel conductive plates 222 mounted on upper and lower sides of the plug body 221. Since the feature of this invention does not reside in the particular configuration of the plug assembly 2, a detailed description of the same is dispensed with herein for the sake of brevity. The earphone jack 3 includes a dielectric housing 4, a conductive first contact set 6, and a conductive second contact set 7.

Figure 2:
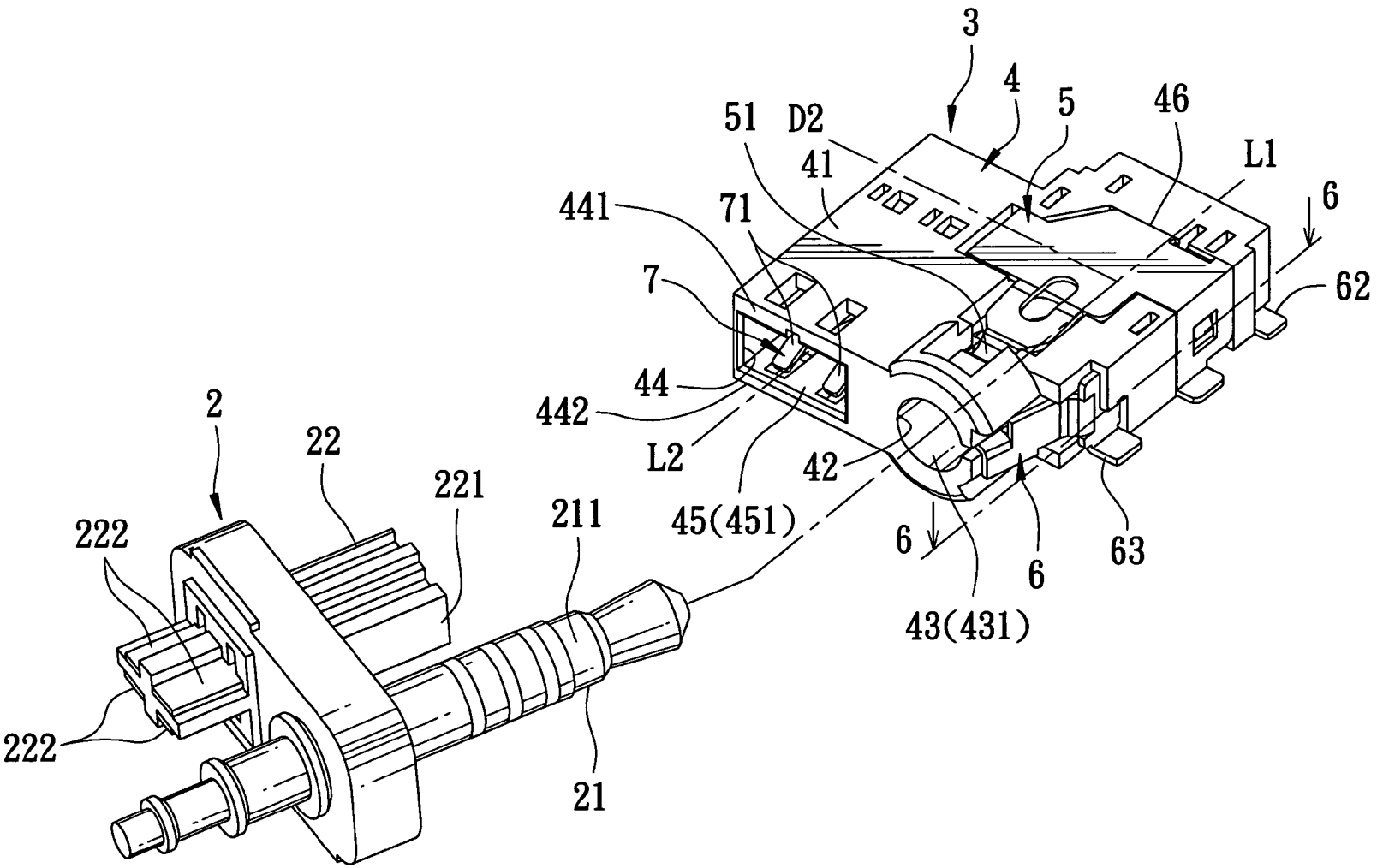
FIG. 2 is a front perspective view of the preferred embodiment of an earphone jack according to the present invention.
Figure 3:
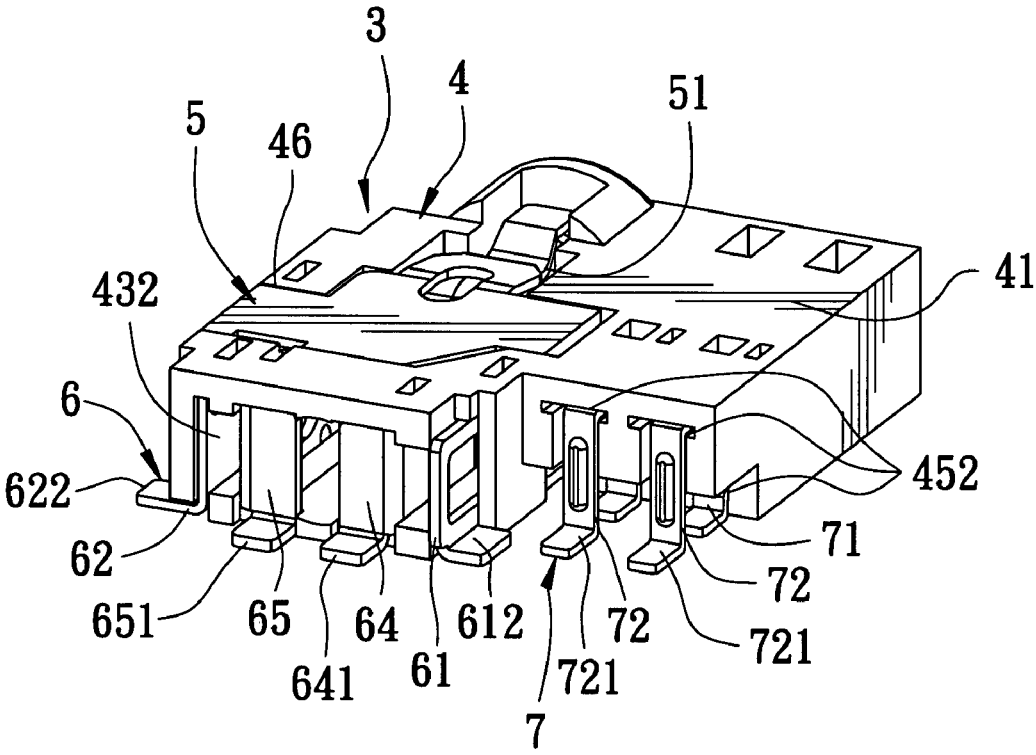
FIG. 3 is a rear perspective view of the preferred embodiment.
Figure 4:
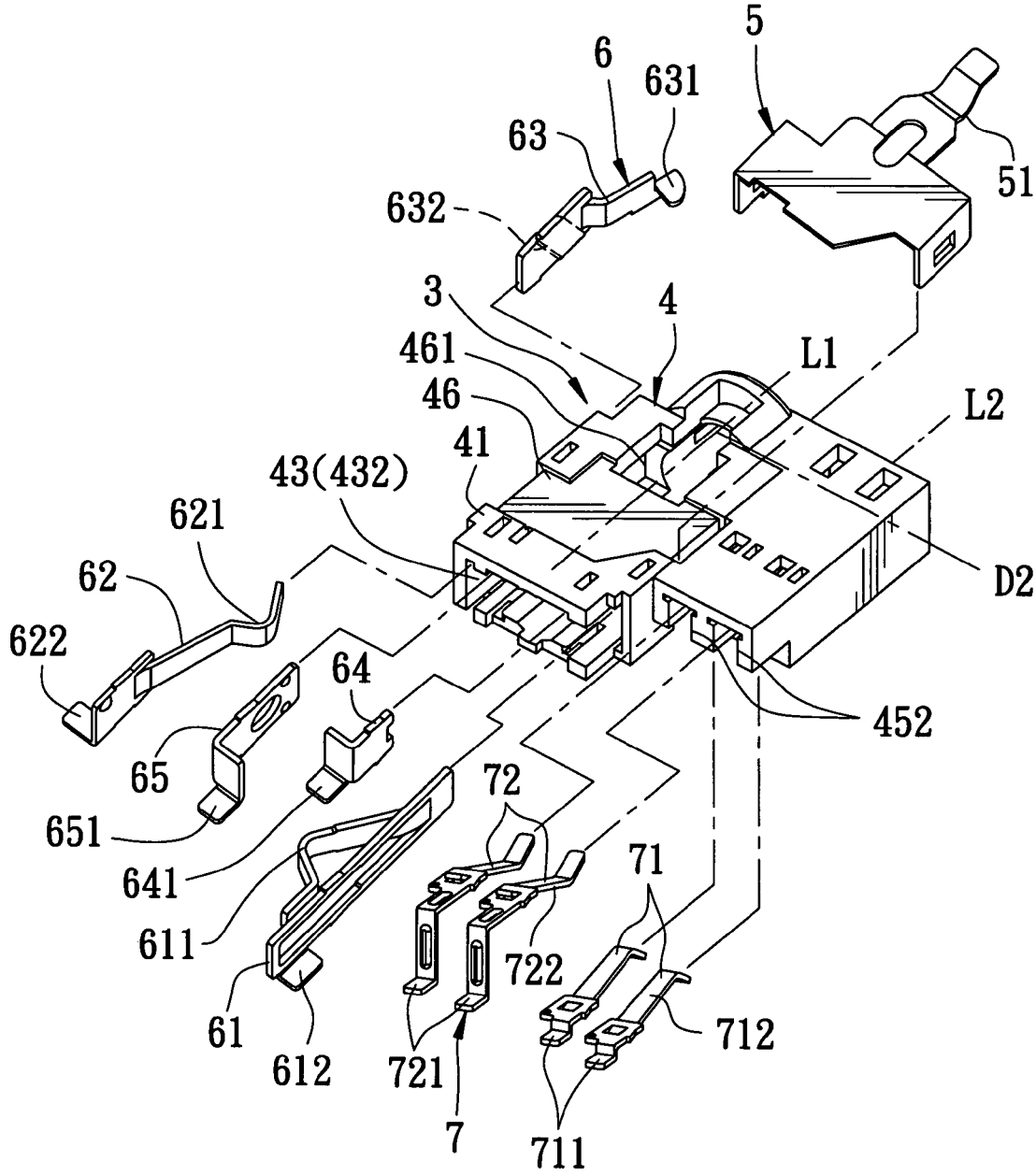
FIG. 4 is an exploded perspective view of the preferred embodiment.
Figure 5:
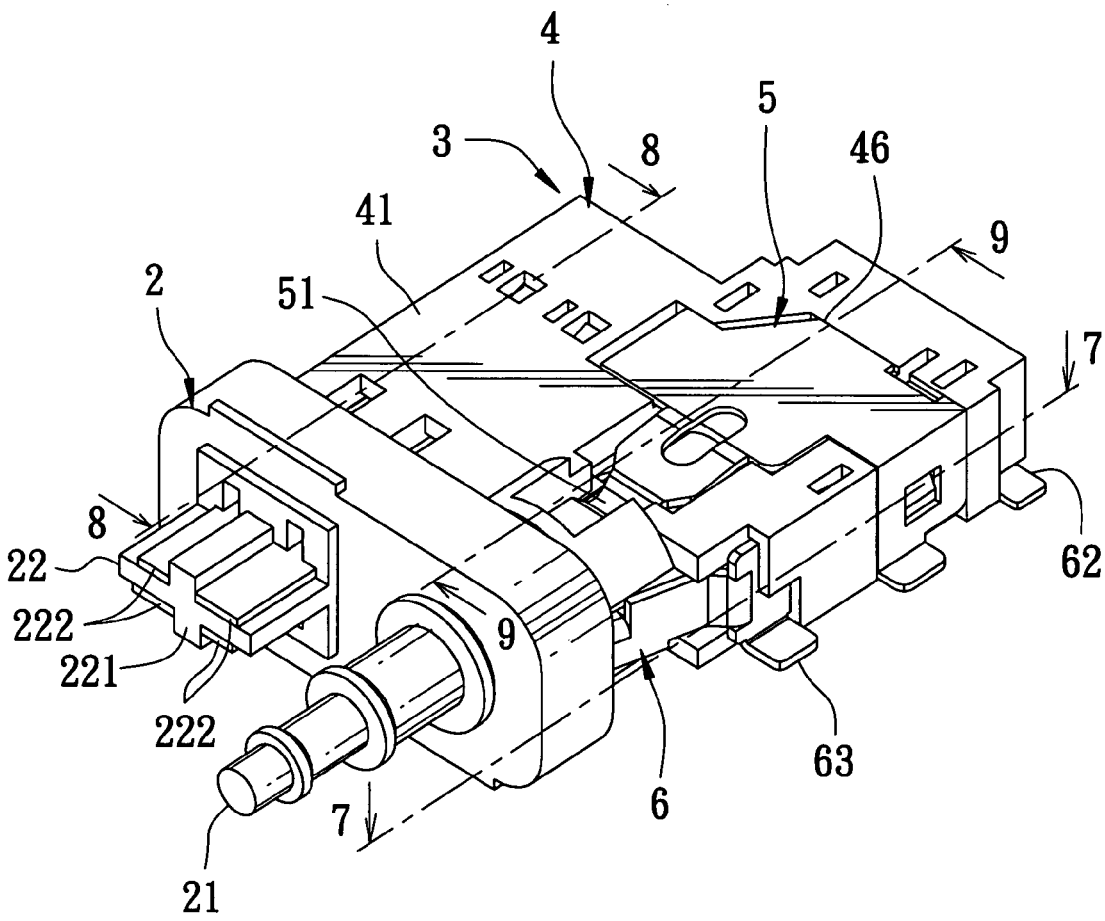
FIG. 5 is a perspective view of the preferred embodiment to illustrate a state where it mates with a complementary plug assembly.
Figure 6:
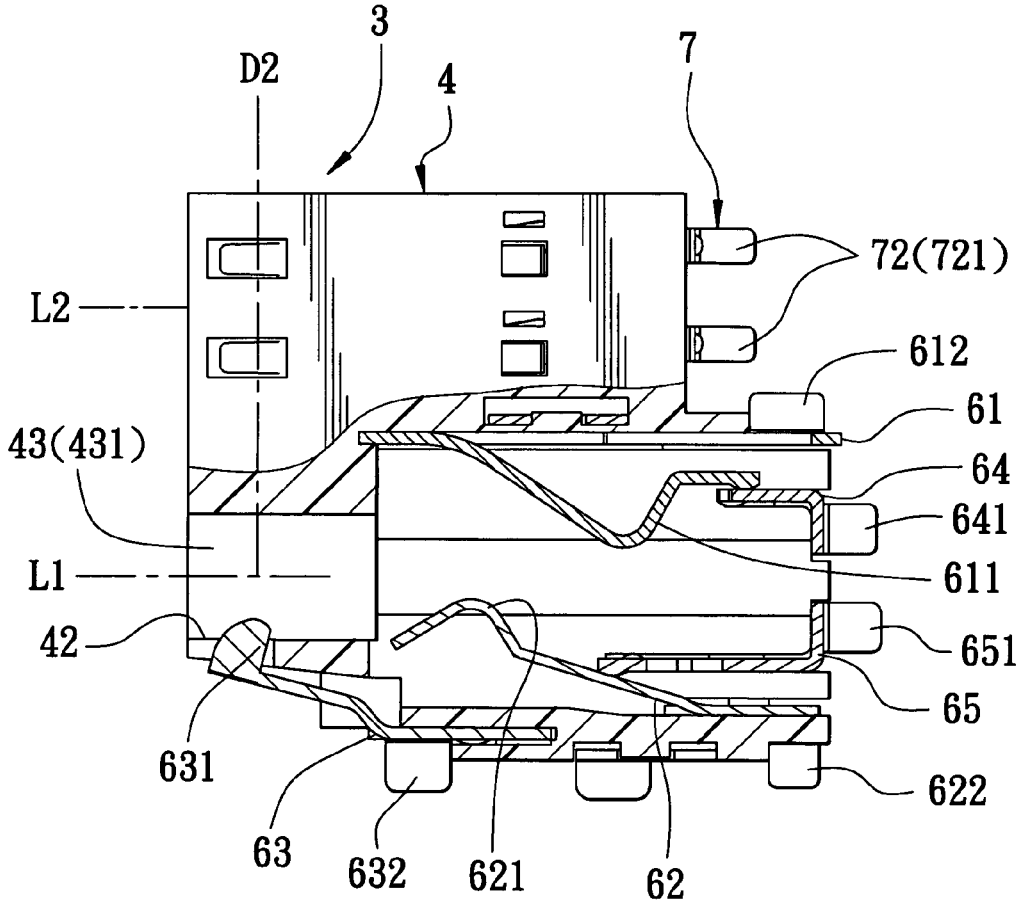
FIG. 6 is a schematic, partly sectional view of the preferred embodiment, taken along Line 6—6 of FIG. 2.

Referring to FIGS. 2, 4 and 6, the dielectric housing 4 has a first housing portion 42 formed with a cylindrical first plug receiving hole 43 that extends along a first hole axis (L1), and a second housing portion 44 connected to the first housing portion 42 and formed with a rectangular second plug receiving hole 45 that extends along a second hole axis (L2) parallel to the first hole axis (L1) and that has a width along a third axis (D2) transverse to the second hole axis (L2). The first plug receiving hole 43 is configured with a circular front opening 431 and a rectangular rear opening 432. The second housing portion 44 includes upper and lower wall parts 441, 442 at upper and lower sides of the second plug receiving hole 45. The second plug receiving hole 45 is configured with a rectangular front opening 451 and four T-shaped rear openings 452 (only two are visible in the drawings).

Figure 7:
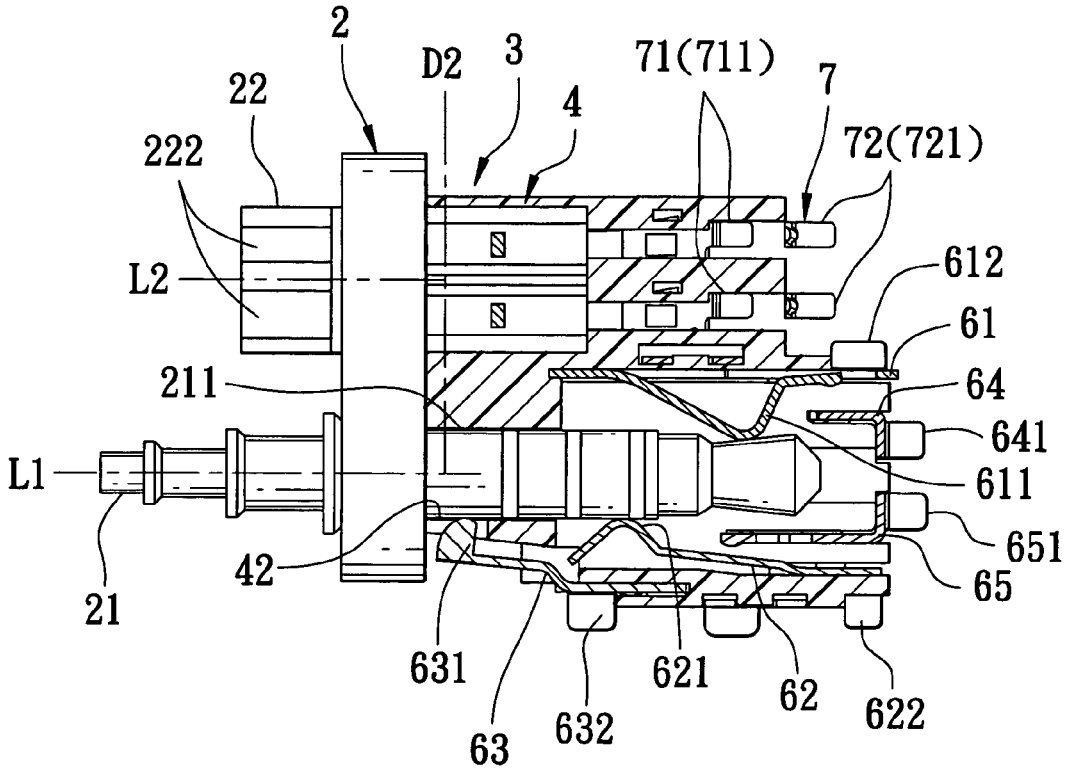
FIG. 7 is a sectional view of the preferred embodiment, taken along Line 7—7 of FIG. 5.

Referring to FIGS. 4, 6 and 7, the conductive first contact set 6 is mounted to the first housing portion 42, and includes first, second and third resilient contacts 61, 62, 63, each of which has a resilient plug contacting portion 611, 621, 631 that extends into the first plug receiving hole 43, and an opposite tail portion 612, 622, 632 disposed outwardly of the first plug receiving hole 43. The plug contacting portions 611, 621, 631 of any pair of the first, second and third resilient contacts 61, 62, 63 form at least one of an angular distance and an axial distance therebetween with respect to the first hole axis (L1). Thus, as best shown in FIG. 7, when the first plug 21 is inserted into the first plug receiving hole 43, the plug contacting portions 611, 621, 631 of the first, second and third resilient contacts 61, 62, 63 abut against different points on the contacting surface 211 of the first plug 21.

Figure 8:
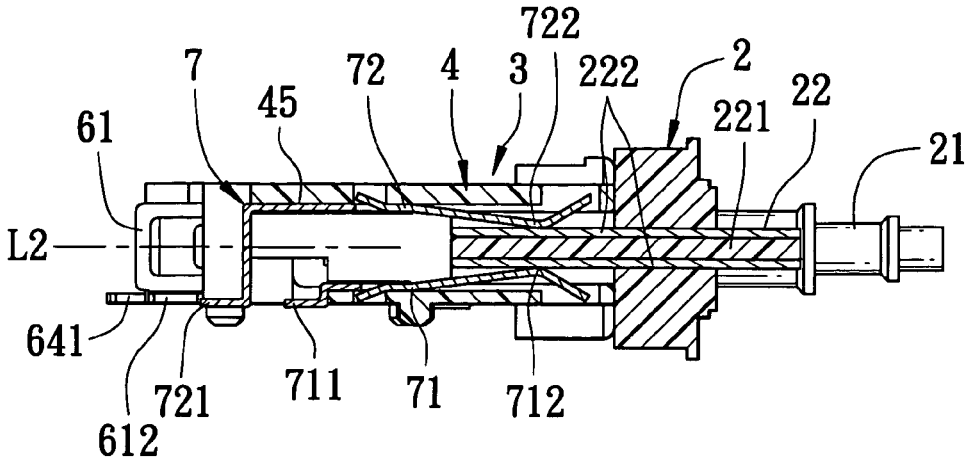
FIG. 8 is another sectional view of the preferred embodiment, taken along Line 8—8 of FIG. 5.

Referring to FIGS. 4, 7 and 8, the conductive second contact set 7 is mounted to the second housing portion 44, and includes a pair of first terminals 71 and a pair of second terminals 72. Each of the first terminals 71 has a plug contacting portion 712 that extends into the second plug receiving hole 45 parallel to the second hole axis (L2) via one of the rear openings 452, and an opposite tail portion 711 disposed outwardly of the second plug receiving hole 45. The first terminals 71 are spaced apart from each other along the third axis (D2), and are disposed proximate to the lower wall part 442 of the second housing portion 44. Each of the second terminals 72 has a plug contacting portion 722 that extends into the second plug receiving hole 45 parallel to the second hole axis (L2) via one of the rear openings 452, and an opposite tail portion 721 disposed outwardly of the second plug receiving hole 45. The second terminals 72 are spaced apart from each other along the third axis (D2), and are disposed proximate to the upper wall part 441 of the second housing portion 44. As best shown in FIG. 7, when the second plug 22 is inserted into the second plug receiving hole 45, the plug contacting portions 712, 722 of the first and second terminals 71, 72 abut against the conductive plates 222 of the second plug 22, respectively.

Referring again to FIGS. 4, 6 and 7, preferably, the conductive first contact set 6 further includes third and fourth terminals 64, 65 disposed to establish electrical connection with the plug contacting portion 611, 621 of a respective one of the first and second resilient contacts 61, 62 when the first plug 21 is yet to be inserted into the first plug receiving hole 43, as best shown in FIG. 6. As best shown in FIG. 7, when the first plug 21 is inserted into the first plug receiving hole 43, the plug contacting portions 611, 621 are pushed away from the third and fourth terminals 64, 65 to break electrical connection therewith. It is noted that each of the third and fourth terminals 64, 65 has a tail portion 641, 651 that is disposed outwardly of the first plug receiving hole 43.

Since the specific mounting arrangement of the first, second and third resilient contacts 61, 62, 63 and the first, second, third and fourth terminals 71, 72, 73, 74 on the dielectric housing 4 is not pertinent to the claimed invention, a detailed description of the same is omitted herein for the sake of brevity.

Figure 9:
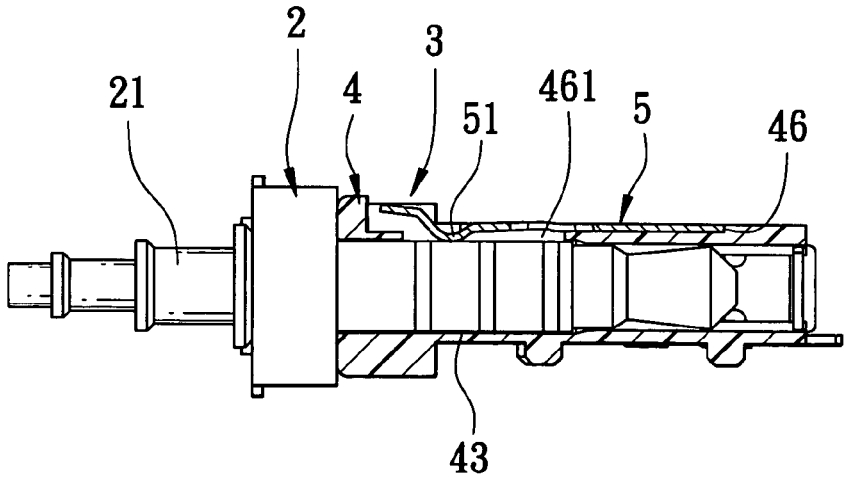
FIG. 9 is yet another sectional view of the preferred embodiment, taken along Line 9—9 of FIG. 5.

Referring once more to FIGS. 2 to 5, the dielectric housing 4 further has a top side 41 that is formed with a mounting recess 46, and an access hole 461 that is formed in the first housing portion 42 and that extends from the first plug receiving hole 43 to the mounting recess 46. A retaining member 5 is mounted in the mounting recess 46, and is formed with a resilient tab 51 that extends into the first plug receiving hole 43 through the access hole 461. As shown in FIG. 9, when the first plug 21 is inserted into first plug receiving hole 43, the resilient tab 51 abuts against the first plug 21 for enhancing retention of the first plug 21 in the first plug receiving hole 43. In this embodiment, the retaining member 5 has a pair of side plates retained on the dielectric housing 4 at two lateral sides of the first plug receiving hole 43.

In use, the tail portions 612, 622, 632, 711, 721, 641, 651 of the first, second and third resilient contacts 61, 62, 63 and the first, second, third and fourth terminals 71, 72, 64, 65 can be connected to various electrical components of an electrical device (not shown) to provide a plurality of functions for the earphone jack 3. Thereafter, when the first and second plugs 21, 22 are inserted into the first and second plug receiving holes 43, 45 and establish electrical connection with the resilient contacts 61, 62, 63 and the first and second terminals 71, 72, electrical signals can be transmitted in a conventional manner from the first and second plugs 21, 22 to the electrical components of the electrical device via the earphone jack 3 of this invention.

The advantages of the earphone jack 3 of this invention are summarized as follows:

1. The plug contacting portions 611, 621, 631 and the resilient tab 51 cooperate to retain securely the first plug 21 in the first plug receiving hole 43. The plug contacting portions 712, 722 of the first and second terminals 71, 72 likewise cooperate to retain securely the second plug 22 in the second plug receiving hole 45.
2. In this invention, the first and second terminals 71, 72 are arranged into upper and lower pairs in the second plug receiving hole 45. As compared to the aforementioned prior art, in which four terminals 12 are arranged spacedly along an axis (d2), the width of the second plug receiving hole 45 along the third axis (D2) is shortened, thereby reducing the dimensions of the dielectric housing 4 to meet current trends toward component miniaturization.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An earphone jack comprising:

a dielectric housing having a first housing portion formed with a cylindrical first plug receiving hole that extends along a first hole axis, and a second housing portion connected to said first housing portion and formed with a rectangular second plug receiving hole that extends along a second hole axis parallel to the first hole axis and that has a width along a third axis transverse to the second hole axis, said second housing portion including upper and lower wall parts at upper and lower sides of said second plug receiving hole;

a conductive first contact set mounted to said first housing portion and including first, second and third resilient contacts, each of which has a resilient plug contacting portion that extends into said first plug receiving hole, wherein said plug contacting portions of any pair of said first, second and third resilient contacts form at least one of an angular distance and an axial distance therebetween with respect to the first hole axis; and a conductive second contact set mounted to said second housing portion and including a pair of first terminals and a pair of second terminals, said first terminals extending into said second plug receiving hole parallel to the second hole axis, being spaced apart from each other along the third axis, and being disposed proximate to said lower wall part of said second housing portion, said second terminals extending into said second plug receiving hole parallel to the second hole axis, being spaced apart from each other along the third axis, and being disposed proximate to said upper wall part of said second housing portion, wherein said dielectric housing further has a top side that is formed with a mounting recess, and an access hole that is formed in said first housing portion and that extends from said first plug receiving hole to said mounting recess, said earphone jack further comprising a retaining member mounted in said mounting recess and formed with a resilient tab that extends into said first plug receiving hole through said access hole.

2. The earphone jack as claimed in claim 1, wherein said first contact set further includes third and fourth terminals, each of which is disposed to establish electrical connection with said plug contacting portion of a respective one of said second and third resilient contacts when a plug is yet to be inserted into said first plug receiving hole.

3. The earphone jack as claimed in claim 2, wherein each of said first, second and third resilient contacts and said third and fourth terminals has a tail portion that is disposed outwardly of said first plug receiving hole.

4. The earphone jack as clamed in claim 1, wherein each of said first and second terminals has a tail portion that is disposed outwardly of said second plug receiving hole.

* * * * *